United States Patent [19]

Margalit

[11] Patent Number: 4,495,718

[45] Date of Patent: Jan. 29, 1985

[54] PHOTOGRAPHIC DISPLAY DEVICE

[76] Inventor: Benjamin Margalit, 3165 Meadowbrook Blvd., Cleve. Hts, Ohio 44118

[21] Appl. No.: 498,983

[22] Filed: May 27, 1983

[51] Int. Cl.[3] ..... A47G 1/06

[52] U.S. Cl. ..... 40/152.2; 40/160; 40/559; 40/561; 40/563

[58] Field of Search ..... 40/1, 152.1, 152.2; 46/24, 25; 40/160, 363, 365, 540, 559, 561, 563

[56] References Cited

U.S. PATENT DOCUMENTS 1,788,058 1/1931 Jyumi ..... 40/152.2

3,990,166 11/1976 Nagelkirk ..... 40/152.2

*Primary Examiner*—Gene Mancene

*Assistant Examiner*—Cary E. Stone

*Attorney, Agent, or Firm*—Woodrow W. Ban

[57] ABSTRACT

A hollowed frustum display device for photographic artwork, the hollowed frustum having an optionally closed end opposing an open end, and being defined by a light transmitting material, a circumference of the open end being greater that the circumference of the closable end. Photographic artwork is applied preferably to inner surfaces of the hollowed frustum, with the photographic artwork being embodied upon a light transmitting material.

22 Claims, 4 Drawing Figures

PHOTOGRAPHIC DISPLAY DEVICE

FIELD OF THE INVENTION

This invention relates to structures and devices for the display of photographic art and more particularly to the display of still photography. Specifically, this invention relates to devices for the non projection display of photographic artwork.

BACKGROUND OF THE INVENTION

A variety of devices or structures for the display of photographic art have been devised since the infancy of photographic art. Traditionally, photographic displays have been effected using either a so called print of a photographic negative upon a generally opaque material such as paper, or by reproducing the photographic subject matter upon a transparent or translucent material such as so called slide film, Mylar®, cellulose acetate or the like through which light may be passed in a focused beam so as to effect projection of a photographic image upon a display surface such as a screen, wall, mirror, or the like.

With respect to so called prints, display forms have generally taken the form of flat displays such as framed photographs mounted upon walls, ceiling, floors, objects of furniture, automobiles, and the like. Typically such prints may be "blown up" or expanded so as to provide enhanced visual effects. The degree to which a print may be blown up is to some extent dependent upon the nature of the film employed in effecting the photograph initially.

These prints have traditionally been produced and marketed in smaller sizes particularly suited for display in book-like photographic albums and have from time to time been mounted in special display formats. One such format is the so-called photographic cube.

These photographic cubes in typical format comprise a generaly hollow cubic structure having walls formed from sheet material generally quite transparent in nature. This transparent materials often is a clear plastic such as a polycarbonate, a Plexiglas® material, or the like, but equally can be of glass. Typically such cubes can be disassembled and photographic prints can be thereby placed behind the transparent surfaces of the cube where the prints are protected from damage yet clearly visible to the eye for viewing. Light for viewing such photographs generally passes through the transparent cube surfaces or sides, reflects from the photographic print(s) mounted within the cube, and then passes again through the transparent material to the eye of a viewer.

In such cubes, the use of transparent or translucent print stock has been discouraged by the need for a solidly opaque surface to effect the necessary reflection of light. In addition, when viewing such a cubic display, only three surfaces of such a cube are generally available for viewing from any particular physical viewer location relative to the cube. Short of elaborate use of mirrors, no convenient manner of viewing all six surfaces of such a cube simultaneously is available to the viewer.

With respect to transparent or translucent photographic reproduction materials, typically such materials require backlighting for adequate viewing, and have found particular favor where employed for projecting a photographic image onto a viewing surface for viewing by a relatively large audience simultaneously. Less frequently, such light transmitting materials have found acceptance for viewing so called slides, film negative sized replications of photographic images, using a personal, relatively small mechanical viewer generally providing a backlighting effect by which the slides may be viewed effectively. Typically such slide based photographic images are viewed in a single dimension, that is only a single photographic image is available for viewing at any one particular time to the viewer.

Systems, structures, and/or devices for the simultaneous viewing of multiple photographic images reproduced upon a light transmitting material could find wide application in the generation of art form and artistic displays and sculpture using the photographic process.

DISCLOSURE OF THE INVENTION

The present invention provides a display structure for artwork, and particularly for photographic artwork. For purposes of this invention, the photographic artwork must be embodied upon a light transmitting substrate.

The display structure of the present invention provides a hollowed frustum having at least one open and a second, optionally but frequently closed end termed here a closable. A structural material defines the hollowed frustum, interconnecting the ends and where appropriate, closing the closed end, thereby defining inner and outer surfaces of the hollowed frustum.

Generally a circumference of one open end of the hollowed frustum is greater that a corresponding circumference of remaining open end or of the closed end if any. Such hollowed frustums typically may have the form of a pyramidrical polyhedron, termed a pyramid for purposes of this disclosure, cones, and elliptical cones. The hollowed frustum is made from a material that is substantially light transmitting and the artwork is applied to at least portions of at least one of the surfaces of the hollowed frustum, preferably the inner surfaces.

In preferred embodiments of the invention, a plurality of the hollowed or so-called hollow frustums are joined together in a desired physical configuration; frequently the hollowed frustums are joined together, most frequently at the closed ends. Desirably, where the artwork is attached to inner surfaces of the hollowed frustums, a source of light surrounds at least partially the hollowed frustums.

BEST EMBODIMENT OF THE INVENTION

Figure 1:
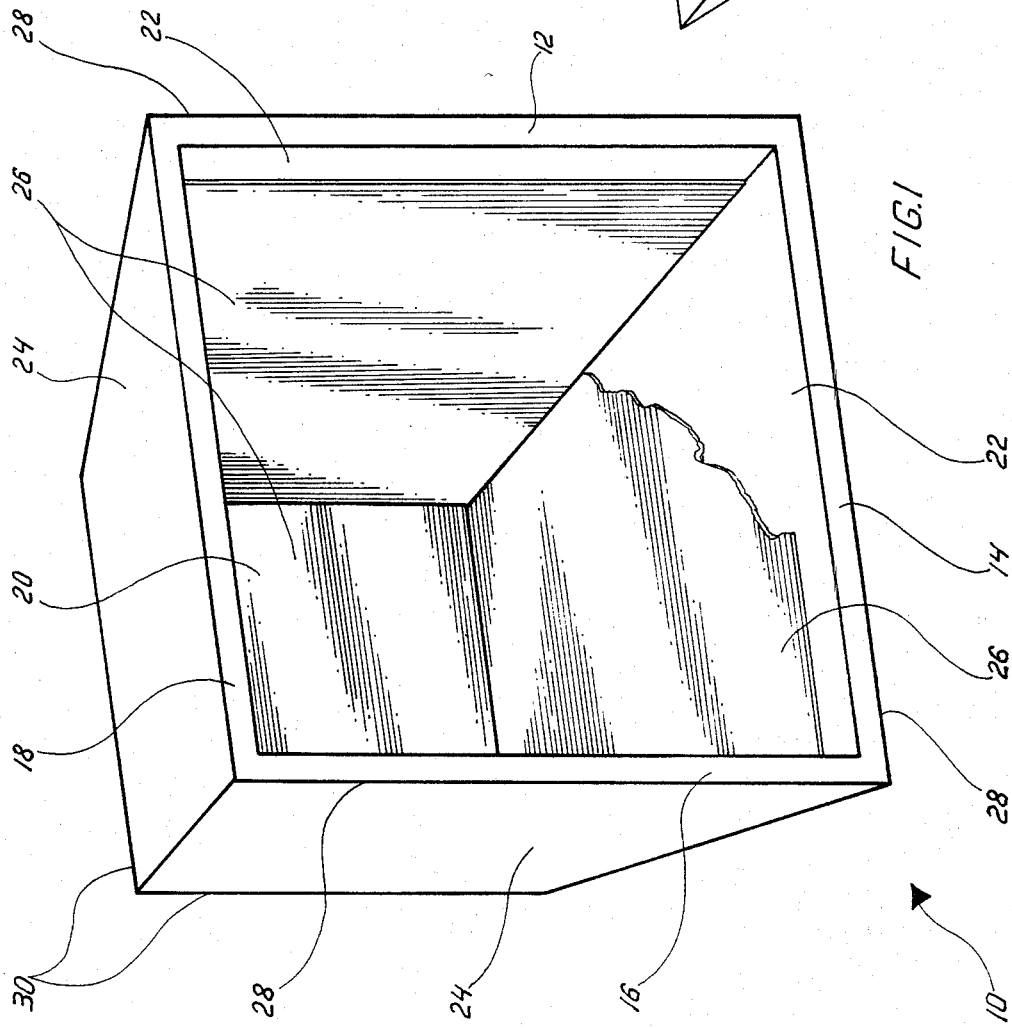
FIG. 1 is a dimetric representation of a hollow frustum for the display of artwork in accordance with the invention.

Referring to the drawings, FIG. 1 is a dimetric representation of an artwork display structure of the invention in the form of a hollow or hollowed frustum 10. The hollow frustum 10 is defined by sides 12, 14, 16, 18 and an end 20 which may be open or closed, but generally is closed, generally opposing an open end through which the interior of the hollow frustum is visible. The sides and closed end are made from a light transmitting structural substance or material although the closed end and/or at least one of the sides may be made from a mirror like material.

The light transmitting structural substance can be either transparent or translucent, but should be capable of transmitting a considerable proportion of any light available for transmission therethrough. The structural substance may be tinted so as to remove certain wavelengths of light from any light being transmitted through the structural substance.

Any suitable or conventional light transmitting structural substance can be employed for the manufacture of the hollow frustum 10 of the invention, such as plastics, glass, mirrors, and particularly one way mirrors and combinations thereof. It is preferable for aesthetic reasons that no framing be visible jointing the sides 12, 14, 16, 18 and/or the closed end 20. Where such jointing framing in essential, it is much preferred that any such framing be also light transmitting and preferably of the same nature with respect to transparency and the materials forming the sides and closed end.

For these and other reasons, plastics have found particular acceptance in the fabrication of the hollow frustums 10 of the instant invention, as such plastic materials are generally relatively easily thermally welded or glued to form structures without the sacrifice of significant light transmitting characteristics or the introduction of substantial differences in degree of transparency of the light transmitting structural substance.

Any suitable or conventional plastic may be employed, either as a thermosetting resin or a thermoplastic resinous material. Such materials are well known in the plastics art, and any such material may be employed either alone or in combination with others to produce a coherent hollow frustum. Typically, the hollow frustum can be made of polyethylene, polypropylene, polycarbonate, ABS resin (acrylonitrile butadiene styrene), methyl methacrylate (Plexiglas®), other acrylic resins such as Lucite®, and polyesters. Such materials may be co-joined in any suitable or conventional manner such as by the use of gluing or thermowelding techniques as may be appropriate.

The hollow frustum 10 includes inner 22 and outer 24 surfaces established or defined by the sides 12, 14, 16, 18 and the end 20 if closed. Applied to at least portions of one or both of these surfaces 22, 24 is a light transmitting artwork substrate 26, generally a film. Embodied upon the artwork substrate 26 is an artwork form, generally a photographic representation, reproduction or screenning as these terms are understood in the arts. The artwork embodiment, could equally preferably be an artform accomplished by the application of light transmitting paints, lacquers, inks or the like to the artwork substrate 26. The artwork substrate is attached to the sides 12, 14, 16, 18 and the closed end using any suitable or conventional method such as gluing or the like.

The artwork substance can be applied to the sides and closed end in a plurality of thicknesses, each thickness optionally bearing a separate artwork embodiment. Such artwork substrates 26 need not be applied over all of either the inner 22 or outer 24 surfaces of the hollow frustum, but preferably the visual effect upon application of the artwork substrates 26 to the hollow frustum 10 is one of complete coverage when the inner surface of the hollow frustum is viewed from an open end. It is much preferred that the artwork substrates be applied to the inner surface 22 of the hollow frustum 10.

The hollow frustum artwork display of the invention preferably is tapered at least internally. Provision for a taper provides a particularly desired visual effect when the inner surface 22 of the hollow frustum 10 is viewed from the open end. The taper can be achieved by making a circumference taken about an outer edge 28 of the open end larger than a corresponding circumference taken about an outer edge 30 of the end 20 which may be closed. Preferably, the circumference of such a so-called closed end 20 is not greater that about 80 percent of the circumference of the open end.

Alternately, an internal taper can be achieved by employing a light transmitting structural substrate material having a greater thickness adjoining the so-called closed end 20 or closable end than adjacent the open end.

The artwork substrate can be any suitable or conventional light transmitting transparent or translucent material. In preferred embodiments of the invention, the artwork substrate is a polyester film such as Mylar®, or a flexible clear plastic resin. Equally, the artwork substrate may be a glass. In preferred embodiments the artwork substrate 26 is a photographic reproduction medium such as a suitable or conventional slide film material or a slide film reproduction material. Other suitable or conventional materials would include cellulose materials such as cellulose acetate or cellulose nitrile.

Figure 2:
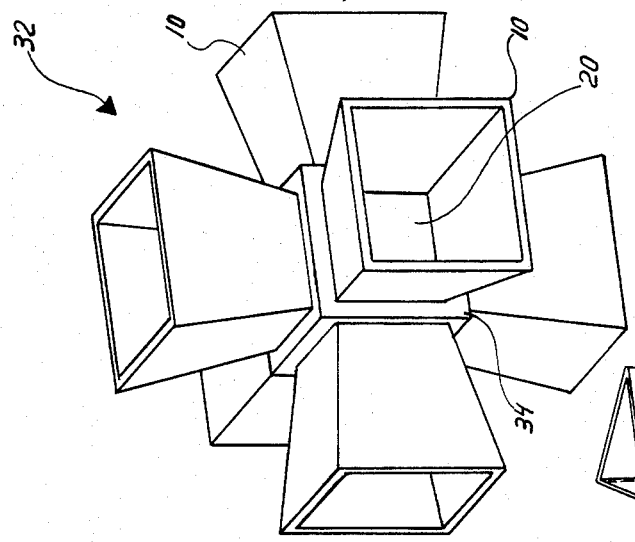
FIG. 2 is a dimetric representation of a plurality of hollow frustums co-joined in accordance with the invention.
Figure 4:
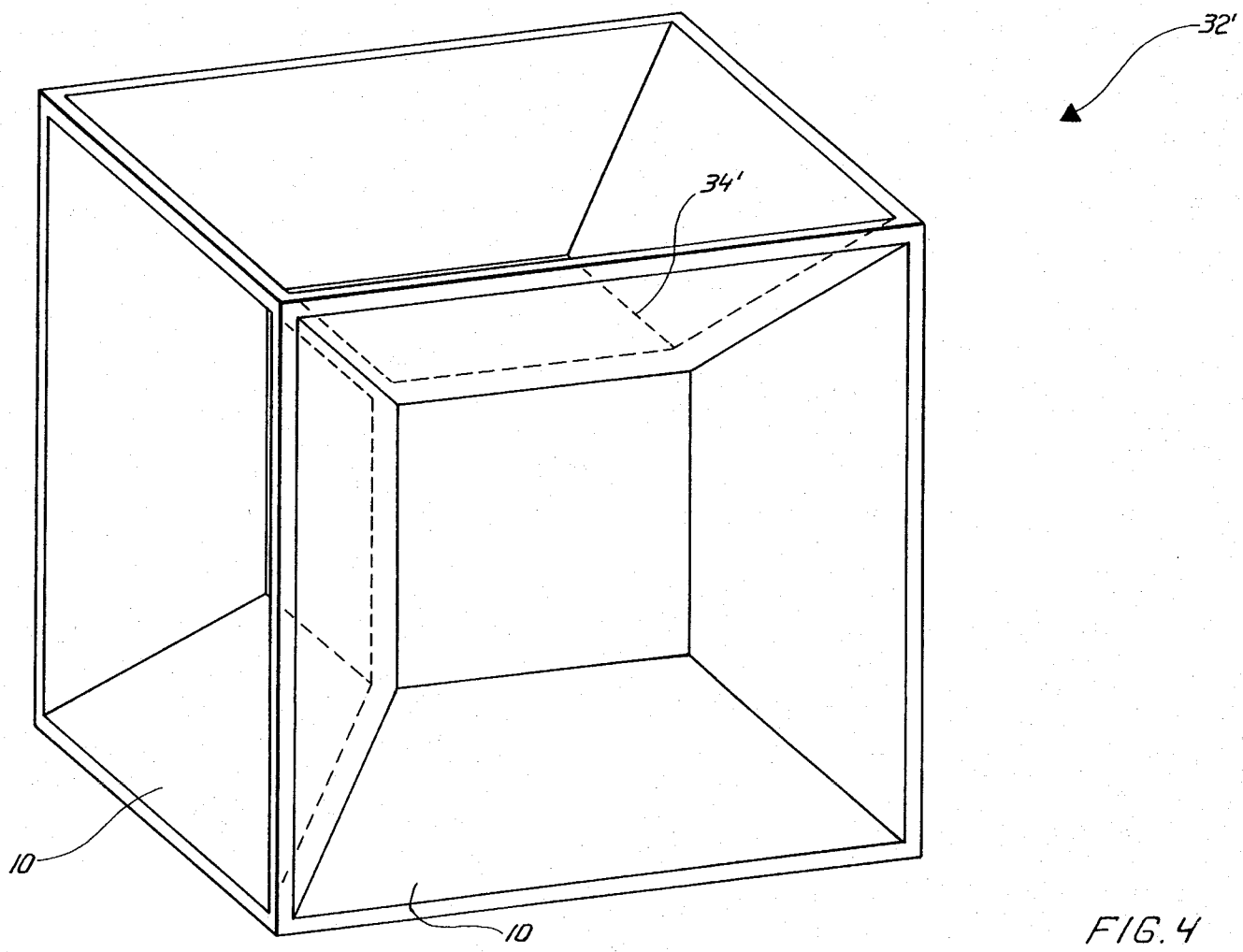
FIG. 4 is a dimetric representation of a plurality of hollow frustums co-joined in accordance with the invention.

Referring to the drawings, FIG. 2 depicts a plurality of the hollow frustum 10 co-joined to form a display 32. The closable or closed ends 20 of each of the hollow frustums are co-joined by gluing, welding, or the like to a spacer 34. The spacer may be formed solely by the closed ends of the hollow frustums 10 co-joined to form the display 32' as shown in FIG. 4, or may be a separate structure. As shown in FIG. 4, the sides of individual frustums 10 may be co-joined one to the next or may be common. Optionally the spacer 34, 34' may include a source of light (not shown) or may be formed without the closable ends of one or more of the frustums 10 being in fact closed. The spacer preferably is made from a light transmitting structural material in accordance with the sides 12, 14, 16, 18 and closed end 20 of the hollow frustums 10.

Figure 3:
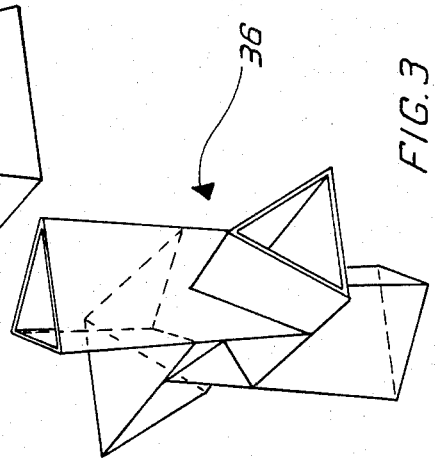
FIG. 3 is a dimetric representation of a plurality of hollow frustums co-joined in accordance with the invention.

Referring to FIG. 3, it may be seen that a hollow frustum display 36 may be of other desired geometric configurations. The closable end of a hollowed frustum employed in such geometrical configurations need not be in a plane parallel with a plane corresponding to the open end of the same hollow frustum. Virtually any geometric shape or combination of geometric shapes may be employed in fabricating a hollow frustum display. Particularly, conical, elliptical conical, and pyramid shape having any number of sides, that is pyramidrical polyhedrons, may be employed.

In certain preferred embodiments of the invention, the hollow frustum 10 is at least partially surrounded by a source of light. This light source may be contained in the spacer 34, for example, or may surround the sides 12, 14, 16, 18 or the hollow frustum 10. Alternately, a particular hollow frustum may contain a light source by which adjcent frustums are illuminated. Such a source of light may be of any suitable or conventional nature as are well known in the art of electrical lighting. Bright room lighting surrounding the hollow frustum may generally suffice for illuminating such frustums.

As used herein, the term frustum is intended to convey the concept of that portion of a geometric solid contained between two cutting planes. The term hollow frustum is intended to have an ordinary meaning flowing from the definition of frustum.

While a preferred embodiment has been shown and described in detail, it will be apparent to those skilled in the art that various alterations and modifications may be made thereto without diverging from the scope of the claims that follow.

What is claimed is:

1. A display structure for artwork embodied upon a light transmitting substrate comprising:

a hollowed frustum having a closable end opposing an open end, the hollowed frustum being defined by a structural material interconnecting the ends and providing any closing of the closable end, thereby defining inner and outer surfaces of the hollowed frustum;

a circumference of the open end being greater than a corresponding circumference of the closable end;

the structural material of the frustum and the closed end being a substance substantially transmitting light; and the light transmitting artwork substrate being applied to portions of at least one of the surfaces, configured for viewing from inside the hollowed frustum via the open end.

2. The display structure of claim 1, the circumference of the closable end being not greater than 80% of the open end circumference.

3. The display structure of claim 2, a plane corresponding to the closable end and a plane corresponding to the open end being substantially parallel.

4. The display structure of claim 1, the light transmitting artwork substrate being applied to at least portions of only the inner surface.

5. The display structure of claim 4, the structural material of the frustum being selected from a group consisting of glass, resinous thermoplastics, and thermosetting plastics.

6. The display structure of claim 5, the frustum being one selected from a group consisting of sections of pyramidrical polyhedrons, cones, and elliptical cones.

7. The display structure of claim 1, surfaces of the hollowed frustum being at least partially surrounded by at least one source of light.

8. A display structure for photographic artwork embodied upon a light transmitting substrate comprising:

a hollowed frustum having a closable end opposing an open end, the hollowed frustum being defined by a structural material interconnecting the ends and providing any closing of the closable end, thereby defining inner and outer surfaces of the hollowed frustum;

a circumference of the open end being greater than a corresponding circumference of the closable end;

the structural material of the frustum and the closed end being a substance substantially transmitting light; and the light transmitting photographic artwork substrate being applied to portions of at least one of the surfaces, configured for viewing from inside the frustum via the open end.

9. The display structure of claim 8, the circumference of the closable end being not greater than 80% of the open end circumference.

10. The display structure of claim 9, a plane corresponding to the closable end and a plane corresponding to the open end being substantially parallel.

11. The display structure of claim 8, the light transmitting photographic artwork substrate being applied to at least portions of only the inner surface.

12. The display structure of claim 11, the structural material of the frustum being selected from a group consisting of glass, mirror, resinous thermoplastics, and thermosetting plastics.

13. The display structure of claim 12, the frustum being one selected from a group consisting of sections of pyramidrical polyhedrons, cones, and elliptical cones.

14. The display structure of claim 8, surfaces of the hollowed frustum being at least partially surrounded by at least one source of light.

15. A display structure for photographic artwork embodied upon a light transmitting substrate comprising: a plurality of hollowed frustums, each hollowed frustum having a closable end opposing an open end, the hollowed frustums being defined by a structural material interconnecting the ends and providing any closing of the closable end of each such hollowed frustum, thereby defining inner and outer surfaces of each hollowed frustum;

a circumference of the open end of each hollowed frustum being greater than a corresponding circumference of the closable end of each hollowed frustum;

the structural material of the hollowed frustum and the closable end of each such hollowed frustum being a substance substantially transmitting light; and the hollowed frustums being joined each to the next to form a desired physical configuration;

the light transmitting photographic artwork substrate being applied to portions of at least one of the surfaces of each such hollowed frustum.

16. The display structure of claim 15, the circumference of the closable end of at least one of the hollowed frustums being not greaer than 90% of the open end circumference of that hollowed frustum.

17. The display structure of claim 16, a plane corresponding to the closable end and a plane corresponding to the open end of at least one of the hollowed frustums being substantially parallel.

18. The display structure of claim 15, the hollowed frustums being joined each to the next by interconnection of the closable ends of at least two of such joined hollowed frustums.

19. The display structure of claim 15, the light transmitting photographic artwork substrate being applied to at least portions of only the inner surfaces of the hollowed frustums.

20. The display structure of claim 19, the structural material of the frustum being selected from a group consisting of glass, mirror, resinous thermoplastics, and thermosetting plastics.

21. The display structure of claim 20, the frustums being selected from a group consisting of sections of pyramidrical polyhedrons, cones, and elliptical cones.

22. The display structure of claim 15, surfaces of at least one of the hollowed frustums being at least partially surrounded by at least one source of light.

* * * * *